United States Patent [19]

Ham et al.

[11] Patent Number: 5,073,350

[45] Date of Patent: Dec. 17, 1991

[54] HEAT EXCHANGER FOR HEATING THE CHARGE OF A CATALYTIC REFORMING UNIT OPERATING UNDER LOW PRESSURE

[75] Inventors: Pierre Ham, La Celle St Cloud; Jean de Bonneville, Rueil-Malmaison, both of France

[73] Assignee: Institut Francais du Petrole, Rueil Malmaison, France

[21] Appl. No.: 572,584

[22] Filed: Aug. 27, 1990

Related U.S. Application Data

[62] Division of Ser. No. 365,259, Oct. 12, 1989, Pat. No. 4,973,400.

[30] Foreign Application Priority Data

Oct. 13, 1988 [FR] France ..... 88 13627

[51] Int. Cl.[5] ..... B01J 4/00

[52] U.S. Cl. ..... 422/190; 422/200; 422/201

[58] Field of Search ..... 422/190, 200, 201, 235; 208/134

[56] References Cited

U.S. PATENT DOCUMENTS

| | | | |
|---|---|---|---|
| 3,882,014 | 5/1975 | Monday et al. | 208/134 |
| 4,129,496 | 12/1978 | Lobada | 208/134 |
| 4,518,574 | 5/1985 | Osman et al. | 423/360 |
| 4,865,624 | 9/1989 | Okada | 423/648.1 X |
| 4,924,021 | 7/1990 | Garwood et al. | 422/190 X |

OTHER PUBLICATIONS

Hawley's Condensed Chemical Dictionary, 11th ed., p. 999, Van Nostrand Reinhold Company, Inc., New York (1987).

*Primary Examiner*—Peter Kratz

*Attorney, Agent, or Firm*—Millen, White & Zelano

[57] ABSTRACT

The invention relates to a means for heating the charge of a catalytic reforming unit operating under low pressure.

The invention more particularly relates to an apparatus having in combination a first heat exchanger (6), in which a recycling gas/liquid charge mixture introduced by pipe (5) is completely vaporized, and a second exchanger (9) in which the charge is heated to an adequate temperature by indirect contact with reforming effluent delivered by pipe (17), which successively passes through the two heat exchangers.

5 Claims, 1 Drawing Sheet

HEAT EXCHANGER FOR HEATING THE CHARGE OF A CATALYTIC REFORMING UNIT OPERATING UNDER LOW PRESSURE

This is a division of application Ser. No. 07/365,259, now U.S. Pat. No. 4,973,400, filed Oct. 12, 1989.

In catalytic reforming processes, the tendency is to operate at ever lower pressures. A few years ago, it was standard practice to operate reactors at pressures of 10 bars ($10\times10^5$ Pascal), whereas now the aim is to operate at about 3 bars ($3\times10^5$ Pascal).

An improved reforming process consists of operating at least two moving bed reactors in series, which can optionally be associated with fixed bed reactors. Such processes are described in the Applicant's U.S. Pat. Nos. 4,133,733 and 4,172,027.

The charge introduced into the first reactor is generally at least partly preheated by indirect heat exchange with the effluent of the last reactor. The thus preheated charge generally passes through a furnace before being admitted into the first reactor. The heat exchanger used is of the conventional tubular or plate type.

The liquid charge is introduced with the recycling gas into the exchanger and is substantially vaporized on leaving the exchanger. When the pressure used in the reactors and the ancillary devices, such as the exchanger in question, is approximately 10 bars, the value permits a correct circulation of the charge through the exchanger tubes or plates. The exchanger and its use then cause no particular realization problems. However, when the pressure used in the reactors is low and in accordance with the present tendency in the refining industry, the path of the charge in the exchanger is less satisfactory. Moreover, when using a high pressure, it is possible to allow within the reforming unit a relatively high pressure drop (delta P) in the exchanger.

However, when the reaction pressure (consequently also the pressure in the exchanger) is low, it is not possible to accept high pressure drops (delta P) and the latter must be limited.

Therefore, to meet this objective, it is important for the sections of the exchangers to be wider. However, wide sections are prejudicial to a correct distribution of the charge-recycling gas mixture in the exchanger. Moreover, the low delta P does not make it possible to guarantee a homogeneous flow in all exchanger sections. Therefore, even if large exchangers are used, vaporization is not satisfactory.

The object of the present invention makes it possible to adapt to low pressure catalytic reforming units, a system of exchangers able to operate correctly. The invention relates to a novel process and a novel low pressure exchange apparatus making it possible to carry out the correct heating of the charge and to rapidly and completely vaporize the charge.

Thus, when the pressure is low in an exchanger, it is much easier to circulate within such an exchanger a gaseous fluid rather than a mixed gaseous-liquid fluid. Therefore, the principle of the invention involves vaporizing the charge in a first exchanger and then bringing the charge to a higher temperature in a second exchanger. With the charge vaporized, it is easier to circulate it even if the pressure is low and even if the section of the second exchanger is high. Moreover, the system of the invention permits a maximum limitation of the pressure drops (delta P).

The apparatus according to the invention is a combination of two exchangers in series traversed by the charge. Preferably, the first exchanger is an indirect tubular exchanger with counter-current flow of charge and reaction effluent, whilst the second exchanger is an indirect plate or tubular exchanger.

Therefore the invention relates to a process for catalytic reforming at low pressure of between 1 and 7 bars of a liquid hydrocarbon charge in at least one reaction zone, with the formation of a gas-accompanied reaction effluent, the gas (or recycling gas) being recycled at least partly into such a reaction zone, the process being characterized in that a mixed gaseous-liquid fluid constituted by:

a. the liquid charge, initially at a temperature between 80° and 110° C. and b. recycling gas is heated by indirect contact with at least part of the reaction effluent in two heat exchange zones arranged in series, the charge being introduced into the first exchange zone where it is substantially vaporized and is then passed into the second heat exchange zone and also characterized in that the reaction effluent is firstly introduced into the second exchange zone at a temperature between 450° and 580° C. and then into the first exchange zone from which it is withdrawn at a temperature between 80° and 110° C., the pressure drop between the exit point of the charge in the second exchange zone and the inlet point of the charge in the first exchange zone being between 0.3 and 1.5 bar ($0.3\times10^5$ and $1.5\times10^5$ Pascal).

More specifically, in the process according to the invention, the liquid charge, mixed with the recycling gas from the catalytic reforming unit, is introduced at a temperature between 80° and 110° C. into a first exchange zone operating in two-phase manner (liquid-gas), in which at a pressure between 1 and 7 bars ($10^5$ Pascal and $7\times10^5$ Pascal) and preferably between 2 and 6.5 bars ($2\times10^5$ and $6.5\times10^5$ Pascal), the charge being substantially vaporized by indirect contact (and preferably in countercurrent with the reaction effluent). The charge vaporized in the first exchange zone is then passed into a second exchange zone operating in single-phase manner (gas) at a pressure slightly below that used in the first exchange zone due to a slight pressure drop.

On leaving the second exchange zone, a charge is recovered at a temperature between approximately 430° and 520° C. The pressure drop between the exit of the charge from the second exchanger and the entry of the charge into the first exchanger is between 0.3 and 1.5 bar ($0.3\times10^5$ and $1.5\times10^5$ Pascal).

The reaction effluent from the catalytic reforming unit circulates in countercurrent manner with the charge in each of the two exchange zones. It enters the second exchange zone at a temperature between 450° and 580° C. and leaves the second exchange zone at generally between 80° and 110° C. The charge drawn off from the second exchange zone is passed into the first catalytic reforming zone after having optionally passed through a furnace to ensure that the charge has an adequate temperature. In a preferred manner, the ratio of the exchange surfaces between the first and second exchange zones is between 1/10 and 5/10 and preferably between 2/10 and 4.5/10 and more particularly between 2.5/10 and 4/10.

Another advantage of the process and apparatus according to the invention is that on using a plate exchanger for the second exchanger and a tubular exchanger for the first exchanger during the condensation of the effluent the walls with which the effluent is in contact become dirty, but as the same can be dismantled, it can be easily cleaned. It is known that plate exchangers are not dismantlable and if they become dirty the only possibility is to chemically clean the exchanger. In the process and apparatus according to the invention, the charge circulating in the second exchanger and which is preferably a plate exchanger has already been vaporized, so that there is no dirtying of the second exchanger.

The invention also relates to an apparatus, characterized in that it comprises in combination (cf. FIG. 1):

a first heat exchanger (6) provided with a pipe (5) for introducing a first fluid containing the liquid charge and a recycling gas from a catalytic reforming unit, provided with a pipe (8) for drawing off the first fluid and also a drawing-off pipe (19) and an introduction pipe (18) for a second fluid from the second exchanger (9) defined hereinafter;

and a second heat exchanger (9) provided with an introduction pipe (8) and a drawing-off pipe (10) for the first fluid from the first heat exchanger and provided with an introduction pipe (17) and a drawing-off pipe (18) for the second fluid, the second fluid being at least partly constituted by the effluent of a reforming reactor, the second fluid being in indirect contact with said first fluid in each of the two exchangers (6) and (9).

In a preferred manner, the first exchanger is a tubular exchanger and the second exchanger a plate exchanger.

DETAILED DESCRIPTION OF THE INVENTION

Figure 1:
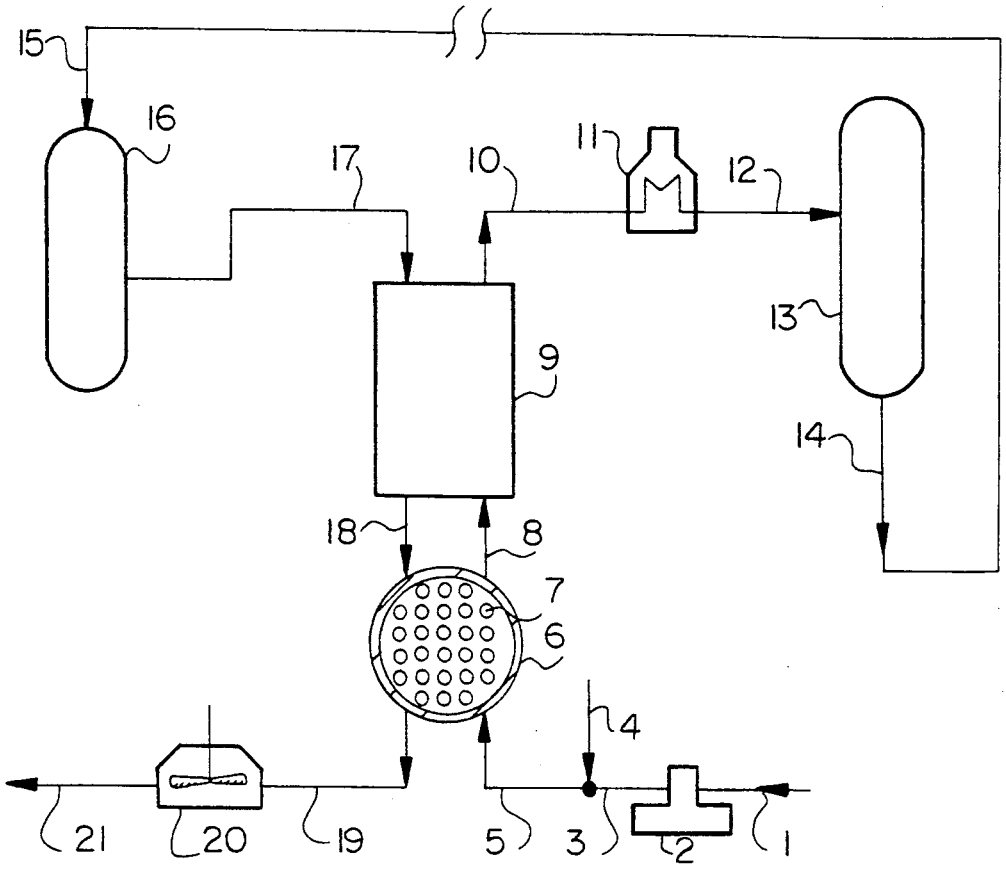
FIG. 1 illustrates an embodiment of the system according the invention.

In FIG. 1, the liquid charge arriving by pipe 4 is mixed in line 5 with the recycling gas from the reforming unit, the recycling gas coming from pipe (1) through pump (2) and pipe (3). The mixed fluid (or double gas-liquid phase) enters a tubular (7) exchanger (6) in indirect countercurrent with the reaction effluent entering exchanger (6) by line (18) and leaving by line (19) to pump (20) and pipe (21). The entirely vaporized charge and the recycling gas pass out of exchanger (6) by pipe (8) and enter a plate exchanger (9), where they are heated by indirect contact with the reaction effluent (line 17) from the last reactor (16) of a series of reforming reactors, the reactor (16) being supplied with vaporized charge by a pipe (15). The charge and recycling gas are drawn off from the plate exchanger (9) by pipe (10), pass through furnace (11) and by pipe (12) supply the first reforming reactor (13) and then continue by line (14) to other reforming reactors.

Figure 2:
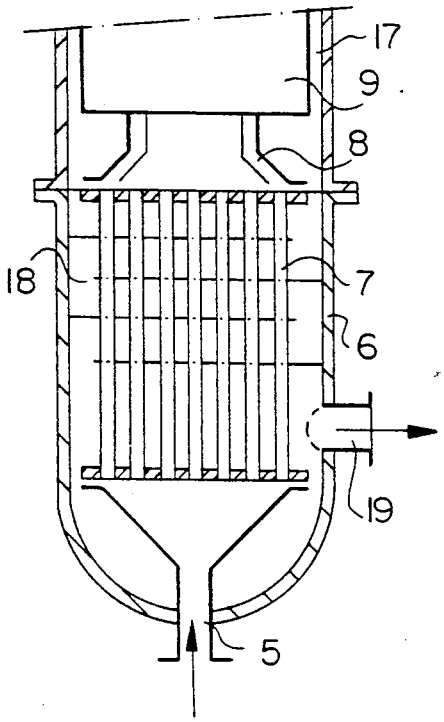
FIG. 2 illustrates an embodiment of the two heat exchangers of the invention.

FIG. 2 shows a particular realization of the apparatus according to the invention having a tubular (7) exchanger (6) and a plate exchanger (9).

EXAMPLES

EXAMPLE 1

For example, use was made of a tubular exchanger and a plate exchanger preceding, in series, a catalytic reforming unit operating at 3 bars ($3\times10^5$ Pascal).

First Exchanger

| | |
|---|---|
| intake temperature of the mixed fluid (charge - recycling gas): | 89° C. |
| intake pressure of the mixed fluid: | 6.2 bars ($6.2 \times 10^5$ Pascal) |
| outlet temperature of the effluent: | 102° C. |
| outlet pressure of the effluent: | 3.8 bars ($3.8 \times 10^5$ Pascal) |
| inlet temperature of the effluent: | 200° C. |

Second Exchanger

| | |
|---|---|
| inlet temperature of the entirely vaporized mixed fluid: | 140° C. |
| outlet temperature of the mixed fluid: | 465° C. |
| outlet pressure of the mixed fluid: | 5.8 bars ($5.8 \times 10^5$ Pascal) |
| | ($0.4 \times 10^5$ Pascal) |
| outlet temperature of the effluent: | 200° C. |
| inlet temperature of the effluent: | 500° C. |
| inlet pressure of the effluent: | 4.2 bars ($4.2 \times 10^5$ Pascal) |
| total pressure drop: 6.2 − 5.8 = | 0.400 bar ($0.4 \times 10^5$ Pascal) |
| exchange surface in the first exchanger: | 1500 $m^2$ |
| exchange surface in the second exchanger: | 4000 $m^2$ |
| total exchange surface: 4000 + 1500 = | 5500 $m^2$ |
| ratio of surfaces $\frac{\text{first exchanger}}{\text{second exchanger}}$ : $\frac{1500}{4000} = \frac{3.75}{10}$ | |

EXAMPLE 2

Comparative

As a comparative example, use was successively made of a single plate exchanger and a single tubular exchanger. Each exchanger had an exchange surface of 5500 $m^2$, i.e., equal to all the exchange surfaces of the two exchangers of the preceding example. The inlet temperatures of the mixed fluid and the reforming effluent were respectively 89° and 500° C.

Every effort was made to have a minimum pressure drop, so that the reforming reaction pressure was 3 bars ($3\times10^5$ bars), as in Example 1.

Under these conditions, the charge was not vaporized in an appropriate manner and the operation of the exchanger was unstable.

We claim:

1. An apparatus for catalytic hydrocarbon reforming comprising:

at least two catalytic reforming reactors in series, means for introducing a vaporized mixture of gas, recycled from a catalytic reforming reactor of said series, and vaporized hydrocarbon charge to a first of said catalytic reforming reactors, means for removing effluent from said first catalytic reforming reactor and delivering said effluent to the next catalytic reformer reactor in the series, means for mixing a liquid hydrocarbon charge and said gas recycled from a catalytic reforming reactor of said series to form a gas/liquid mixture, means for delivering said gas/liquid mixture to a first indirect heat exchanger wherein said liquid hydrocarbon charge is vaporized to form said vaporized mixture, means for removing said vaporized mixture from said first indirect heat exchanger and delivering said vaporized mixture to a second indirect heat exchanger, means for removing said vaporized mixture from said second indirect heat exchanger and delivering said vaporized mixture to said means for introducing a vaporized mixture of said first catalytic reformer reactor, means for removing a final reactor effluent from the last catalytic reforming reactor in said series and delivering said final reactor effluent to said second indirect heat exchanger wherein said final reactor effluent undergoes heat exchange with said vaporized mixture, means for removing said final reactor effluent from said second indirect heat exchanger and delivering said final reactor effluent to said first indirect heat exchanger wherein said final reactor effluent undergoes further heat exchange with said gas/liquid mixture means for removing said final reactor effluent from said first indirect heat exchanger and wherein the ratio of exchange surface area in said first indirect heat exchanger to exchange surface area in said second indirect heat exchanger is 1:10–5:10.

2. An apparatus according to claim 1, wherein said first exchanger is a tubular exchanger and said second exchanger is a plate exchanger.

3. An apparatus according to claim 1, wherein said first and second exchangers are both tubular exchangers.

4. An apparatus according to claim 1, wherein the ratio of exchange surface area in said first heat exchanger to exchange surface area in said second heat exchanger is 2:10–4.5:10.

5. An apparatus according to claim 1, wherein the ratio of exchange surface area in said first heat exchanger to exchange surface area in said second heat exchanger is 2.5:10–4:10.

* * * * *